US008204268B2

(12) United States Patent
Li

(10) Patent No.: US 8,204,268 B2
(45) Date of Patent: Jun. 19, 2012

(54) WIRED CONTROL OF EARPHONE

(75) Inventor: Xiong Li, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 332 days.

(21) Appl. No.: 12/564,906

(22) Filed: Sep. 22, 2009

(65) Prior Publication Data

US 2010/0329500 A1 Dec. 30, 2010

(30) Foreign Application Priority Data

Jun. 29, 2009 (CN) ..... 2009 1 0303811

(51) Int. Cl.
*H04R 25/00* (2006.01)

(52) U.S. Cl. ..... 381/384; 381/74; 381/379; 381/387

(58) Field of Classification Search ..... 381/74, 381/384, 386; 200/336, 237, 329
See application file for complete search history.

(56) References Cited

U.S. PATENT DOCUMENTS

| | | | | |
|---|---|---|---|---|
| 4,829,571 | A * | 5/1989 | Kakiuchi et al. | 381/309 |
| 7,671,818 | B2 * | 3/2010 | Nagano et al. | 343/850 |
| 7,920,902 | B2 * | 4/2011 | Carroll | 455/569.1 |
| 7,920,920 | B1 * | 4/2011 | Williamson | 607/28 |
| 2009/0095605 | A1 * | 4/2009 | No | 200/1 B |
| 2010/0054493 | A1 * | 3/2010 | Lin et al. | 381/74 |

* cited by examiner

*Primary Examiner* — Davetta W Goins
*Assistant Examiner* — Jasmine Pritchard
(74) *Attorney, Agent, or Firm* — Altis Law Group, Inc.

(57) ABSTRACT

The present invention provides a wired control of an earphone. The wired control includes a ring and a body. The ring defines an elastic material structure and a plurality of rails. The body defines at least one protrusion which is mounted with a plurality of circuit boards, wherein each circuit board is electrically mounted with a switch thereon; the ring is rotatably mounted on the body; and each switch is operable in response either to the elastic material structure being pressed or to the rails of the ring being rotated. When one of the switches is activated by the movement of the ring, the circuit board corresponding to the activated switch generates a trigger signal.

12 Claims, 4 Drawing Sheets

WIRED CONTROL OF EARPHONE

BACKGROUND

1. Technical Field

The disclosure relates to earphones and, more particularly, to a wired control of an earphone.

2. Description of the Related Art

Electronic apparatuses, such as mobile phones, media players, may be controlled by a wired control of an earphone. The wired control of an earphone generally provides a plurality of function keys for touching or pressing to perform functions. However, the function keys can be operated only by touching or pressing, therefore, the limited operation manners are simple and boring.

BRIEF DESCRIPTION OF THE DRAWINGS

The components in the drawings are not necessarily drawn to scale, the emphasis instead being placed upon clearly illustrating the principles of the wired control of an earphone. Moreover, in the drawings, like reference numerals designate corresponding parts throughout the several views.

DETAILED DESCRIPTION

Figure 1:
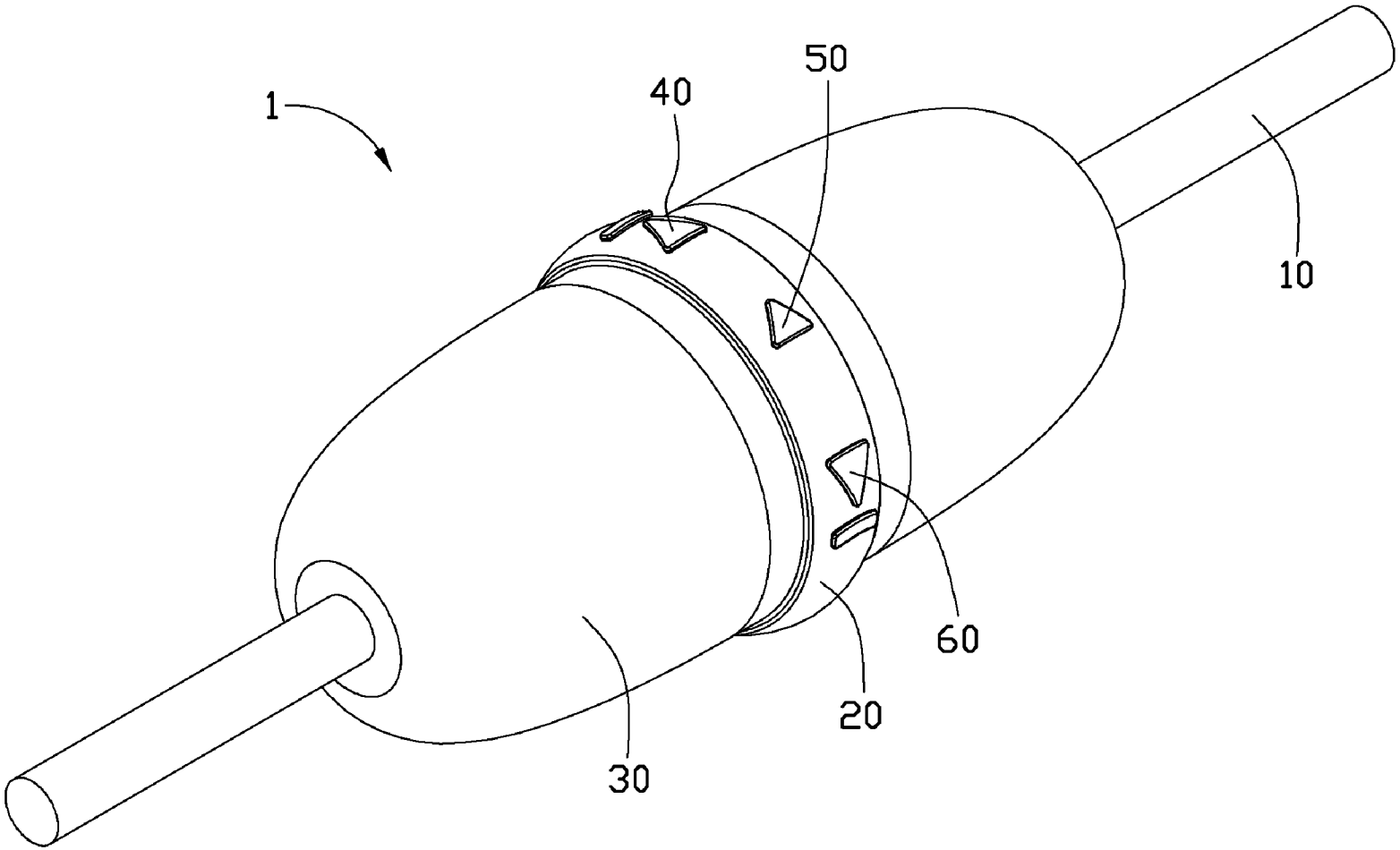
FIG. 1 is a perspective view of a wired control of an earphone in accordance with an embodiment.

FIG. 1 is a perspective view of a wired control of an earphone in accordance with an embodiment. The wired control 1 is adapted for an electronic device, such as a mobile phone, a media player, and so on. The wired control 1 is connected to the electronic device and the earphone (both not shown) by an earphone line 10.

The wired control 1 includes a ring 20 and a body 30. The ring 20 can be rotated around the body 30. The ring 20 provides one or more input signs on its outer circumferential surface, for example, such as that shown in FIG. 1, a first sign 40, a second sign 50, and a third sign 60. The second sign 50 is used to prompt a user that a position where the second sign 50 is placed can be touched or pressed, and is assigned an elastic material structure beneath thereof. The first sign 40 is used to prompt the user that the ring 20 can be rotated along a first orientation, such as a clockwise orientation. The third sign 60 is used to prompt the user that the ring 20 can be rotated along a second orientation, such as a counterclockwise.

Figure 2:
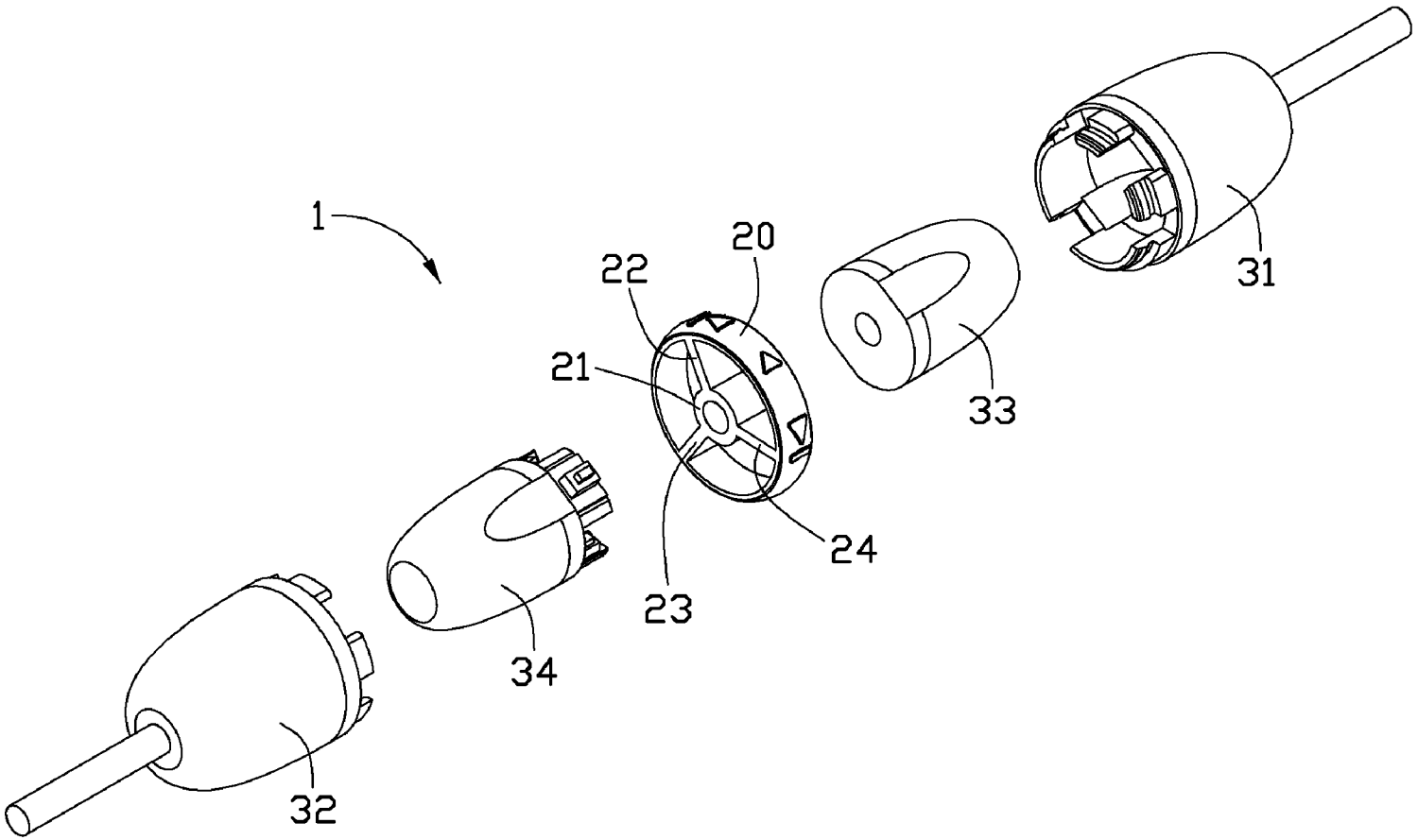
FIG. 2 is an exploded, perspective view of the wired control of FIG. 1.

FIG. 2 is an exploded, perspective view of the wired control of FIG. 1. The ring 20, substantially wheel-shaped, further defines a through hole 21 and three rails 22-24 in its interior. Typically, the through hole 21 is defined in the middle of the ring 20. One end of each of the rails 22-24 is connected to the inner circumferential surface of the ring 20, and the other end is connected to the outer circumferential surface of the through hole 21. The body 30 includes a first crust 31, a second crust 32, a first body 33, and a second body 34. The first crust 31 covers the first body 33 and the second crust 32 covers the second body 34.

Figure 3:
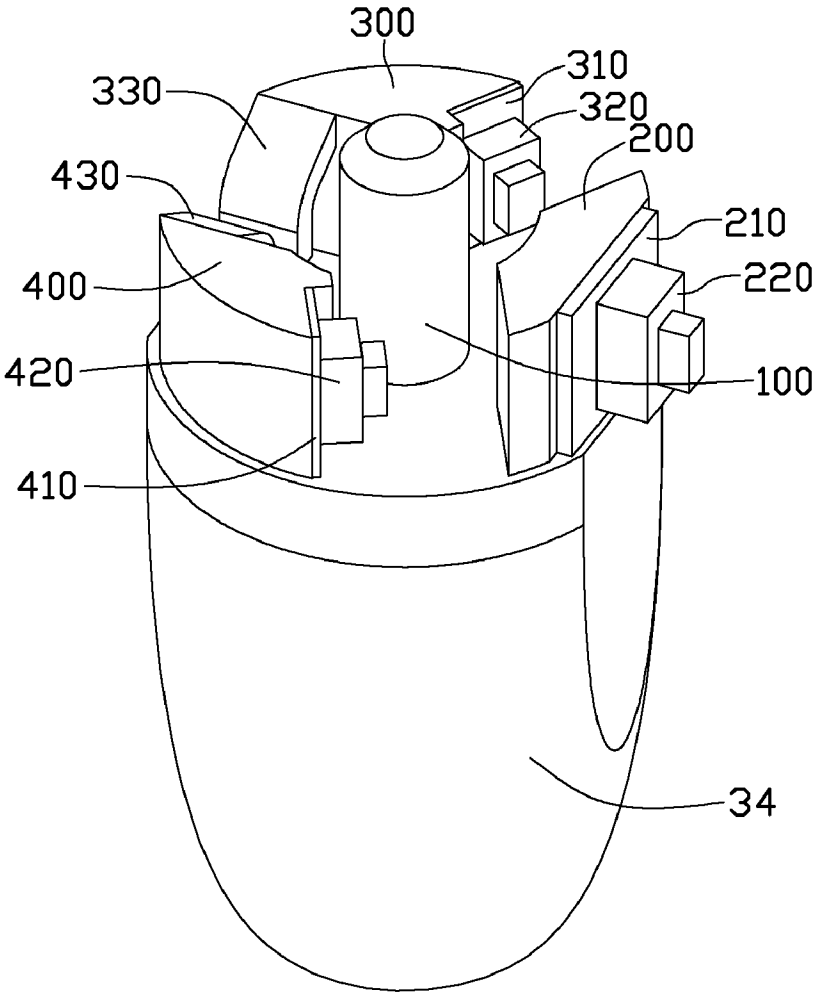
FIG. 3 is a partial, perspective view of a body of the wired control of FIG. 1.
Figure 4:
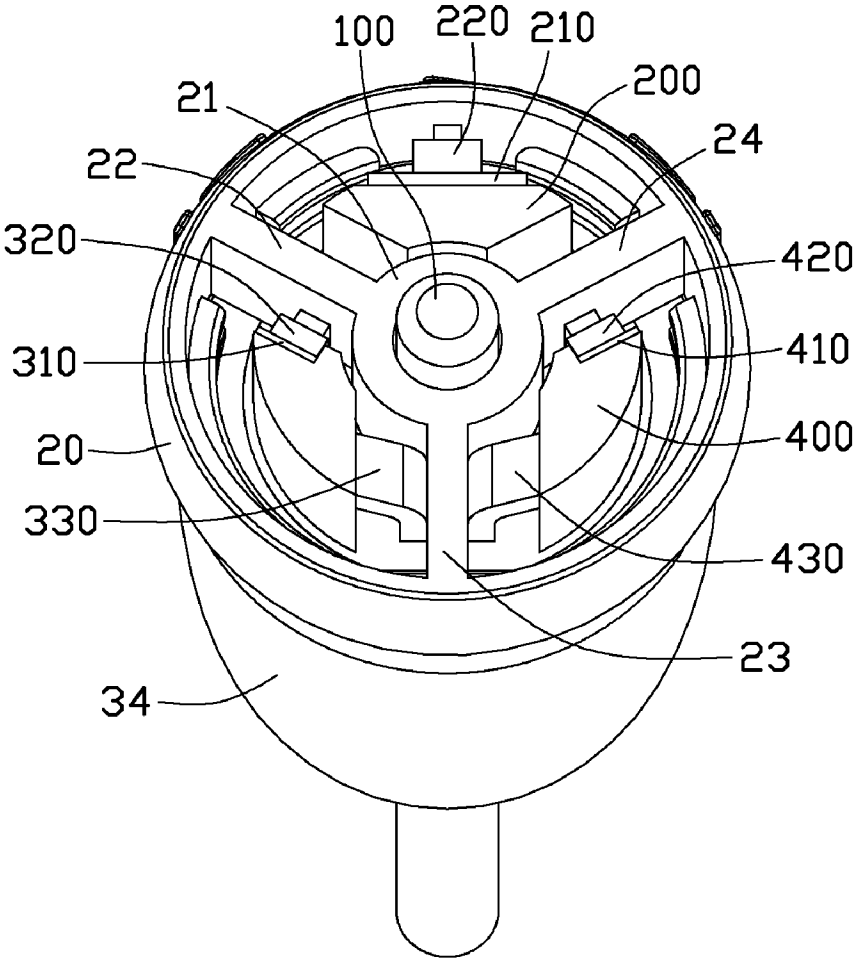
FIG. 4 is a perspective view of the body of FIG. 3 assembled with a ring of the wired control of FIG. 1.

Referring to FIG. 3 and FIG. 4, an axis 100 is extended from an end face of the second body 34. Typically, the axis 100 is extended from the middle of the end face of the second body 34. The end face of the second body 34 further defines three protrusions thereon. The protrusions are symmetrically around the axis 100 and are separated from each other for a predetermined space, adjacent two of which can hold one of the rails 22-24. In other words, each protrusion is positioned between each two rails. For example, a protrusion 200 is positioned between the rails 22 and 24, a protrusion 300 is positioned between the rails 22 and 23, and a protrusion 400 is positioned between the rails 23 and 24.

The protrusion 200 is mounted with a circuit board 210 on its outer surface. The circuit board 210 is electrically mounted with a switch 220 thereon. The protrusion 300 is mounted with a circuit board 310 on its side face, which faces the rail 22. The circuit board 310 is electrically mounted with a switch 320 thereon. The protrusion 300 is further mounted with a spring clip 330 on its another side face, which faces the rail 23. The protrusion 400 is mounted with a circuit board 410 on its side face, which faces the rail 24. The circuit board 410 is electrically mounted with a switch 420 thereon. The protrusion 400 is further mounted with a spring clip 430 on its another side face, which faces the rail 23. The circuit boards 210, 310 and 410 are connected to the electronic device by electrical lines and generate trigger signals to the electronic device in response to user operations, thus, the electronic device performs a function based on the trigger signal.

When the axis 100 is engaged with the through hole 21, and the rail 23 is clamped between the spring clips 330 and 430, thus, the second body 34 is engaged with the ring 20, and, the ring 20 can rotate around the axis 100 of the second body 34. The switch 220 faces the elastic material structure of the second sign 50 on the ring 20, the switch 320 faces the rail 22, and the switch 420 faces the rail 24.

When the second sign 50 on the ring 20 is touched or pressed, the switch 220 is touched, and the circuit board 210 connected with the switch 220 generates a trigger signal to the electronic device, thereby the electronic device performs a first function.

When the ring 20 is rotated along the first orientation based on the first sign 40, the rail 22 is rotated along the first orientation and touches the switch 320, and the circuit board 310 connected with the switch 320 generates a trigger signal to the electronic device, thereby, the electronic device performs a second function. During the first rotation operation, the rail 23 is detached from the spring clip 330 and extruded towards the spring clip 430, and the spring clip 430 is deformed and generates an elastic force. When the first rotation operation is ended, the rail 23 moves towards the orientation opposite to the first rotation orientation based on the elastic force and the ring 20 resumes to the original state, that is, the rail 23 is clamped between the spring clips 330 and 430.

When the ring 20 is rotated along the second orientation based on the third sign 60, the rail 24 is rotated along the second orientation and touches the switch 420, and the circuit board 410 connected with the switch 420 generates a trigger signal to the electronic device, thereby, the electronic device performs a third function. During the second rotation operation, the rail 23 is detached from the spring clip 430 and extruded towards the spring clip 330, and the spring clip 330 is deformed and generates an elastic force. When the second rotation operation is ended, the rail 23 moves towards the orientation opposite to the second rotation orientation based on the elastic force and the ring 20 resumes to the original state, that is, the rail 23 is clamped between the spring clips 330 and 430.

In another embodiment, a first protrusion is mounted with three circuit boards on its outer face and on its two side faces, respectively, each circuit board is electrically mounted with a switch thereon, a second protrusion is mounted with a first spring clip on its side face and a third protrusion is mounted with a second spring clip on its side face, and both the first spring clip and the second spring clip face the same rail. For example, the protrusion 200 is mounted with the circuit board 210 on its outer face and the circuit boards 310, 410 on its two side faces, the circuit boards 210, 310, 410 are electrically mounted with the switches 220, 320, 420, the protrusion 300 is mounted with the spring clip 330 on its side face, the protrusion 400 is mounted with the spring clip 430 on its side face, and both the spring clips 330, 430 face the same rail 23.

In yet another embodiment, a first protrusion is mounted with three circuit boards on its outer face and on its two side faces, respectively, each circuit board is electrically mounted with a switch thereon, a second protrusion is mounted with a first spring clip on its side face, which faces a first rail, and a third protrusion is mounted with a second spring clip on its side face, which faces a second rail. For example, the protrusion 200 is mounted with the circuit board 210 on its outer face and the circuit boards 310, 410 on its two side faces, the circuit boards 210, 310, 410 are electrically mounted with the switches 220, 320, 420, the protrusion 300 is mounted with the spring clip 330 on its side face, which faces the rail 22, and the protrusion 400 is mounted with the spring clip 430 on its side face, which faces the rail 24, thus, no need the rail 23.

It is understood that the disclosure may be embodied in other forms without departing from the spirit thereof. Thus, the present examples and embodiments are to be considered in all respects as illustrative and not restrictive, and the disclosure is not to be limited to the details given herein.

What is claimed is:

1. A wired control of an earphone, the wired control comprising:

a ring defining a through hole in the middle and a plurality of rails, wherein one end of each of the plurality of rails is connected to the inner surface of the ring, and the other end is connected to the outer surface of the through hole; and a body defining an axis extended from the middle and three protrusions each of which is mounted with a circuit board, wherein the circuit board is electrically mounted with a switch thereon and connected to a circuit of the earphone;

wherein the axis of the body is engaged with the through hole of the ring, one of the three switches faces the inner surface of the ring and each of the other two of the three switches faces one of the plurality of rails, and the ring is rotatably mounted on the body; and when the switch is activated by the movement of the ring, the circuit board corresponding to the activated switch generates a trigger signal to the earphone so as to perform a function.

2. The wired control as recited in claim 1, wherein each of two of the three protrusions is mounted with a spring clip thereon and the spring clip faces one of the plurality of rails.

3. The wired control as recited in claim 2, wherein when the switch facing the inner surface of the ring is touched, the circuit board connected with the switch generates a trigger signal to the earphone, and the earphone performs a first function;

when the ring is rotated along a first orientation, one of the other two switches touches one of the plurality of rails, the circuit board connected with the one of the other two switches generates the trigger signal to the earphone, and the earphone performs a second function, one of the two spring clip is deformed and generates a first elastic force, when the first rotation operation is ended, the ring resumes to an original state based on the first elastic force; and when the ring is rotated along a second orientation, the other of the other two switches touches one of the plurality of rails, the circuit board connected with the other of the other two switches generates the trigger signal to the earphone, and the earphone performs a third function, the other of the two spring clip is deformed and generates a second elastic force, when the second rotation operation is ended, the ring resumes to the original state based on the second elastic force.

4. The wired control as recited in claim 2, wherein the number of the plurality of rails is three and two of the three rails hold one protrusion; the first protrusion is mounted with the first circuit board facing the inner surface of the ring, the second protrusion is mounted with the second circuit board facing the first rail, the third protrusion is mounted with the third circuit board facing the second rail, the second protrusion is further mounted with a first spring clip on its another side face, the third protrusion is further mounted with a second spring clip on its another side face, the third rail is clamped between the two spring clips.

5. The wired control as recited in claim 2, wherein the number of the plurality of rails is three; the first protrusion is mounted with three circuit boards on its outer face and on its two side faces, the first circuit board faces the inner surface of the ring, the second circuit board faces the first rail, and the third circuit board faces the second rail, the second protrusion is mounted with a first spring clip on its side face, the third protrusion is mounted with a second spring clip on its side face, and both the first spring clip and the second spring clip face the third rail.

6. The wired control as recited in claim 2, wherein the number of the plurality of rails is two; the first protrusion is mounted with three circuit boards on its outer face and on its two side faces, the first circuit board faces the inner surface of the ring, the second circuit board faces the first rail, and the third circuit board faces the second rail, the second protrusion is mounted with a first spring clip facing the first rail, and the third protrusion is mounted with a second spring clip on its side facing the second rail.

7. An earphone with a wired control, wherein the wired control comprises:

a ring defining a through hole in the middle and a plurality of rails, wherein one end of each of the plurality of rails is connected to the inner surface of the ring, and the other end is connected to the outer surface of the through hole; and a body defining an axis extended from the middle and three protrusions each of which is mounted with a circuit board, wherein the circuit board is electrically mounted with a switch thereon and connected to a circuit of the earphone;

wherein the axis of the body is engaged with the through hole of the ring, one of the three switches faces the inner surface of the ring and each of the other two of the three switches faces one of the plurality of rails, and the ring is rotatably mounted on the body; and when the switch is activated by the movement of the ring, the circuit board corresponding to the activated switch generates a trigger signal to the earphone so as to perform a function.

8. The earphone as recited in claim 7, wherein each of two of the three protrusions is mounted with a spring clip thereon and the spring clip faces one of the plurality of rails.

9. The earphone as recited in claim 7, wherein when the switch facing the inner surface of the ring is touched, the circuit board connected with the switch generates a trigger signal to the earphone, and the earphone performs a first function;

when the ring is rotated along a first orientation, one of the other two switches touches one of the plurality of rails, the circuit board connected with the one of the other two switches generates the trigger signal to the earphone, and the earphone performs a second function, one of the two spring clip is deformed and generates a first elastic force, when the first rotation operation is ended, the ring resumes to an original state based on the first elastic force; and when the ring is rotated along a second orientation, the other of the other two switches touches one of the plurality of rails, the circuit board connected with the other of the other two switches generates the trigger signal to the earphone, and the earphone performs a third function, the other of the two spring clip is deformed and generates a second elastic force, when the second rotation operation is ended, the ring resumes to the original state based on the second elastic force.

10. The earphone as recited in claim 8, wherein the number of the plurality of rails is three and two of the three rails hold one protrusion; the first protrusion is mounted with the first circuit board facing the inner surface of the ring, the second protrusion is mounted with the second circuit board facing the first rail, the third protrusion is mounted with the third circuit board facing the second rail, the second protrusion is further mounted with a first spring clip on its another side face, the third protrusion is further mounted with a second spring clip on its another side face, the third rail is clamped between the two spring clips.

11. The earphone as recited in claim 8, wherein the number of the plurality of rails is three; the first protrusion is mounted with three circuit boards on its outer face and on its two side faces, the first circuit board faces the inner surface of the ring, the second circuit board faces the first rail, and the third circuit board faces the second rail, the second protrusion is mounted with a first spring clip on its side face, the third protrusion is mounted with a second spring clip on its side face, and both the first spring clip and the second spring clip face the third rail.

12. The earphone as recited in claim 8, wherein the number of the plurality of rails is two; the first protrusion is mounted with three circuit boards on its outer face and on its two side faces, the first circuit board faces the inner surface of the ring, the second circuit board faces the first rail, and the third circuit board faces the second rail, the second protrusion is mounted with a first spring clip facing the first rail, and the third protrusion is mounted with a second spring clip facing the second rail.

* * * * *